US006206498B1

(12) United States Patent
Kondo et al.

(10) Patent No.: US 6,206,498 B1
(45) Date of Patent: Mar. 27, 2001

(54) INK PURGE APPARATUS, INK PURGING METHOD NOZZLE WIPING APPARATUS AND WIPING METHOD IN PRINTER

(75) Inventors: Norimasa Kondo; Yasuo Takano; Kazuo Sugano, all of Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/325,409

(22) Filed: Jun. 4, 1999

(30) Foreign Application Priority Data

Jun. 4, 1998 (JP) ..... 10-155649
Jul. 17, 1998 (JP) ..... 10-203235

(51) Int. Cl.[7] ..... B41J 2/165

(52) U.S. Cl. ..... 347/30; 347/33

(58) Field of Search ..... 347/33, 29, 35, 347/30

(56) References Cited

U.S. PATENT DOCUMENTS 5,966,145 * 10/1999 Miura et al. ..... 347/9

FOREIGN PATENT DOCUMENTS 4-111149 4/1992 (JP) .
405064895 * 3/1993 (JP) ..... 347/33

* cited by examiner

*Primary Examiner*—N. Le
*Assistant Examiner*—Shih-Wen Hsieh
(74) *Attorney, Agent, or Firm*—Pillsbury Madison & Sutro LLP

(57) ABSTRACT

A nozzle wiping apparatus comprises an ink-absorbent sheet placed below the ink discard hole to collect the sucked ink discarded through the ink discard hole and an ink absorbent sheet winding mechanism to wind up the ink-absorbent sheet. The ink-absorbent sheet is kept in contact with a part of the nozzles after completion of the purging operation so the nozzles may be moved relative to the ink-absorbent sheet to thereby wipe ink deposited on the nozzles.

10 Claims, 4 Drawing Sheets

INK PURGE APPARATUS, INK PURGING METHOD NOZZLE WIPING APPARATUS AND WIPING METHOD IN PRINTER

BACKGROUND OF THE INVENTION

1. Field of the Invention

The present invention relates to an ink purge apparatus, an ink purging method, a nozzle wiping apparatus and a wiping method in a printer using hot-melt ink.

2. Description of the Related Art

Examples of a method for purging a print head using hot-melt solid ink include: a method in which an ink chamber of the print head is pressurized to discharge ink from an orifice; and a method in which a suction unit is pressed against an orifice to suck ink from the orifice directly. As the ink chamber pressurizing method, a method in which waste ink is sucked by a sheet of wiping paper is employed in manufactured articles. On the other hand, as the orifice suction method, there is a method described in Japanese Patent Unexamined Publication No. Hei 4-111149.

In the orifice suction method, however, a surface of the orifice may be stained with ink when the ink is sucked from the orifice or ink may be spilled around the head when the ink is discarded.

SUMMARY OF THE INVENTION

The present invention has been made in order to solve the above problems with the prior art, and therefore an object of the invention is to provide an ink purge apparatus of the suction type which is simplified in structure without using a motor and a solenoid, resulting in the reduction of the costs.

Another object of the present invention is to provide an ink purge apparatus which prevents the orifice surface from being stained with ink when the orifices are sucked and prevents the ink from being spilled around the head when the ink is discarded.

Still another object of the present invention is to provide an ink purging method in which an ink discarding process is simple.

Yet still another object of the present invention is to provide an apparatus having a simple configuration for wiping a nozzle surface, and a wiping method, particularly, to provide a method for preventing ink from being spilled around a head.

In order to achieve the above object,according to the present invention, there is provided an ink purge apparatus for use in a printer for discharging an ink which is located outside of a printing region of an ink jet head having a horizontally and vertically movable mechanism, in which when the ink received in an ink tank of said ink jet head is discharged, said ink jet head is moved out of the printing region, the ink received within the ink tank is sucked from a nozzle portion of the ink jet head and discharged to the external, said apparatus comprising:

an ink suction casing with an opening portion that comes in close contact with and covers the nozzle portion of the ink jet head when the ink jet head moves forward up to a given position;

a mechanism for moving the nozzle portion of the ink jet head forward and backward relatively with respect to said ink purge casing;

a suction pump connected to said ink suction casing;

an ink discard hole portion provided on the bottom of said ink suction casing for discharging the ink;

open/close means for said ink discard hole portion, said open/close means having a protrusion which is made of an elastic member and a tip of which protrudes from the opening surface of said ink suction casing when the tip is out of contact with the ink jet head, said open/close means closing said ink discarding hole while being pushed by said protrusion when the ink jet head moves forward toward said ink purge casing.

The ink purge apparatus may be designed such that the opening portion of said ink suction casing has an elastic seal member which is brought into close contact with the nozzle plate surface of said ink jet head, the elastic member of said open/close means is molded integrally with said seal member and has a valve portion located on an extension of said protrusion portion and below said ink discarding hole, and the value portion and the peripheral bottom portion of the ink discarding hole of said ink suction casing are inclined and face each other.

The ink purge apparatus may be designed such that said printer includes an easel to which an object to be printed is fixed and guides disposed on said easel for guiding the movement of the ink jet head horizontally and vertically, and said ink purge unit is disposed on an arbitrary end portion of said easel.

The ink purge apparatus may be designed such that the ink received within the ink tank of the ink jet head is a thermally meltable ink, and said ink purge unit includes a heat for melting the ink within said ink suction casing.

Also, according to the present invention, there is provided an ink purge method for use in a printer in which a thermally melted ink received within an ink tank of the ink jet head is sucked and discharged from a nozzle portion of an ink jet heat toward the exterior of the ink jet head by ink suction purge means, said method comprising the steps of:

providing on a bottom portion of an ink suction casing of said purge means an ink discard hole from which the sucked melted ink is discharged to the external;

disposing a suction ink sheet and a suction ink sheet winding-up means below the ink discard hole; and discarding the ink sucked and collected by said purge means onto said suction ink sheet while the suction ink sheet is wound up by the winding-up means to discard the ink.

Further, according to the present invention, there is provided an nozzle wiping apparatus for use in a printer comprising an ink jet head constituted by an ink tank for reserving ink, a plurality of nozzles provided so as to discharge ink as liquid drops by an ink drop generating means, and a carriage for carrying these nozzles to an arbitrary position, an easel erected substantially vertically, a printing medium fixed onto said easel, a suction purge means disposed at an arbitrary end portion on said easel and in a position facing said nozzles, and a moving means for making said nozzles move forward or backward relative to said suction purge means, whereby printing is performed by moving horizontally and vertically relative to said easel, said nozzle wiping apparatus comprising:

a waste ink discard means for discarding ink sucked by said suction purge means;

an ink-absorbent sheet placed below said waste ink discard means; and a winding-up means for winding said ink-absorbent sheet up;

wherein said ink-absorbent sheet is always brought in contact with a part of said nozzles during a purging operation.

The nozzle wiping apparatus may be designed such that said ink-absorbent sheet winding-up means comprises a driving roller, a driven roller, a pulley, a guide cover slidably engaged with opposite ends or one end of said pulley, and a spring having one end fixed to said guide cover and the other end fitted to one end of said pulley.

The nozzle wiping apparatus may be designed such that said ink-absorbent sheet winding-up means comprises a driving roller, a driven roller, a pulley, a guide base for rotatably mounting said pulley, said driving roller and said driven roller, a pivot for making said guide base rockable, and a spring laid between said easel and said guide base.

The nozzle wiping apparatus may be designed such that a part of said ink-absorbent sheet winding-up means is made rockable in linkage with said purging operation.

Also, in the above-described nozzle wiping apparatus of a printer, a wiping method comprising the steps of:

moving said ink jet head resting in an arbitrary position of said easel to a position facing said suction purge means;

advancing said ink jet head toward said suction purge means to bring only said ink-absorbent sheet into contact with a part of a nozzle plate;

further advancing said ink jet head to bring said ink jet head into contact with said suction purge means to perform a purging operation;

retracting said ink jet head from said suction purge means while bringing said ink-absorbent sheet into contact with said nozzle plate after completion of said purging operation; and moving said ink jet head downward while bringing said ink-absorbent sheet into contact with said nozzle plate to thereby wipe ink deposited on said nozzle plate.

DETAILED DESCRIPTION OF THE PREFERRED EMBODIMENTS

Now, a description will be given in more detail of the preferred embodiments of the present invention with reference to the accompanying drawings.

Figure 7:
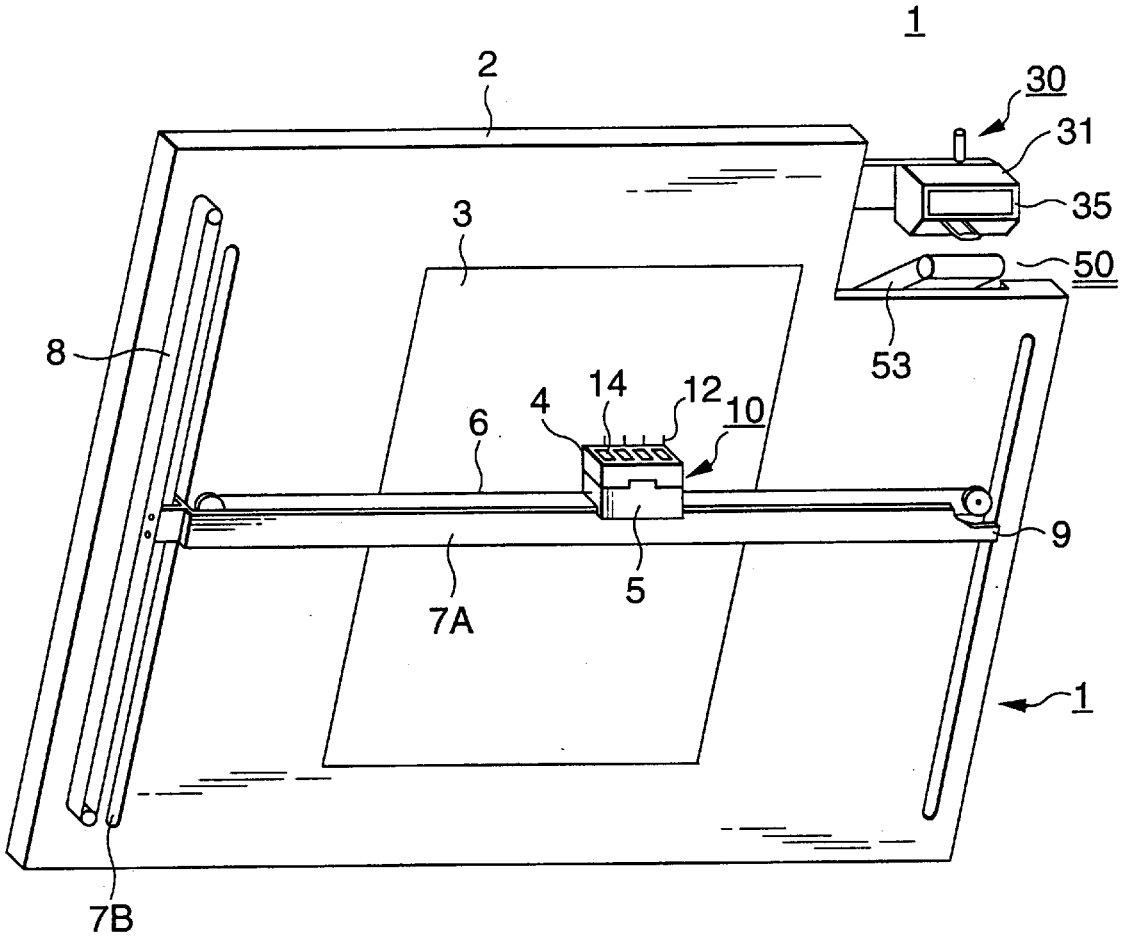
FIG. 7 is a perspective view showing the overall configuration of the printer in the present invention.

The configuration of a printer 1 is shown in FIG. 7.

A sheet of printing paper 3 is stuck onto a front surface of an easel 2 erected substantially vertically. An ink jet head 10, which can move horizontally and vertically freely on a front surface of the sheet of printing paper 3, is constituted by a carriage 5, an ink tank 4 attached on an upper portion of the carriage 5, and a nozzle plate 11 provided in front of the ink tank for jetting ink. Reference numeral 12 designates claw portions; and 14, designates ink chambers.

A plurality of nozzles (not shown) are disposed in the nozzle plate 11 so as to eject ink droplets from a nozzle portion through ink droplet generating means (not shown), for example, a piezoelectric element in response to an image signal.

The reference numeral 6 designates a wire for pulling the ink jet head 10 through a scanning drive mechanism (not shown) horizontally, by which the ink jet head 10 moves horizontally while being guided by a guide 7A. Reference numeral 9 denotes pulleys supported by the guide 7A and a guide 7B for holding the wire 6. Reference numeral 8 designates a belt for moving the ink jet head vertically, and the belt drive allows the ink jet head 10 to move vertically while being guided by the guide 7B. An end of the guide 7A is attached to the belt 8.

An ink purge unit 30 is disposed on an edge portion of the easel 2, for example, on an upper corner of the easel 2. Reference numeral 50 denotes an ink-absorbent sheet winding-up means; also referred to as an ink absorbent sheet winding mechanism and 53, an ink-absorbent sheet.

Figure 1:
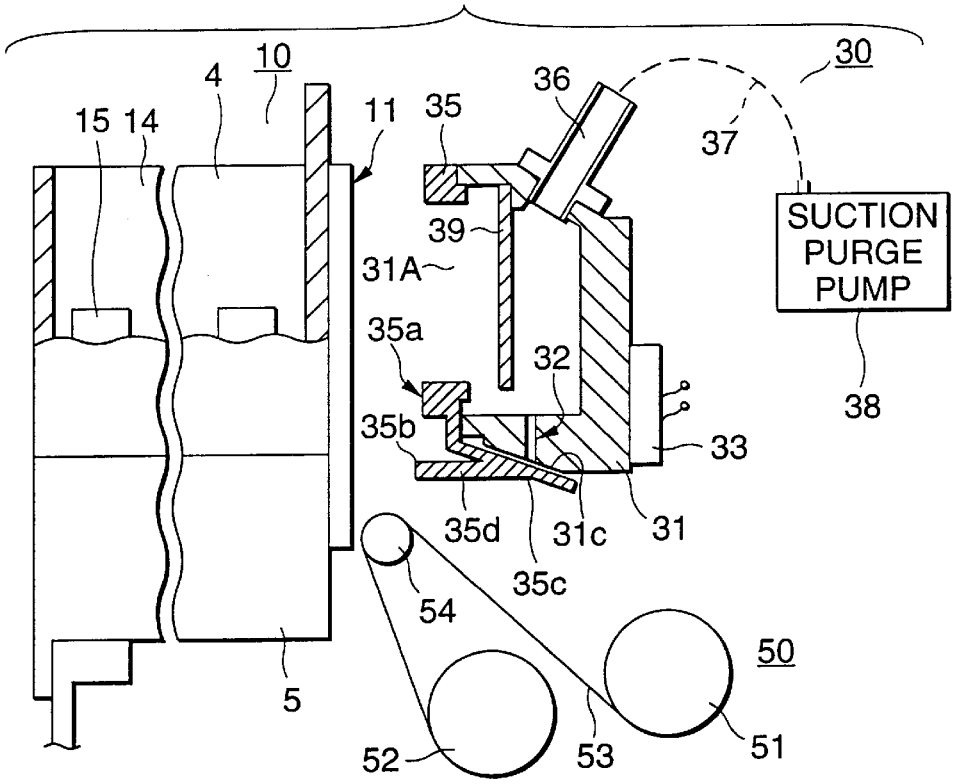
FIG. 1 is a sectional view showing the purging operation of a printer in the present invention.
Figure 2:
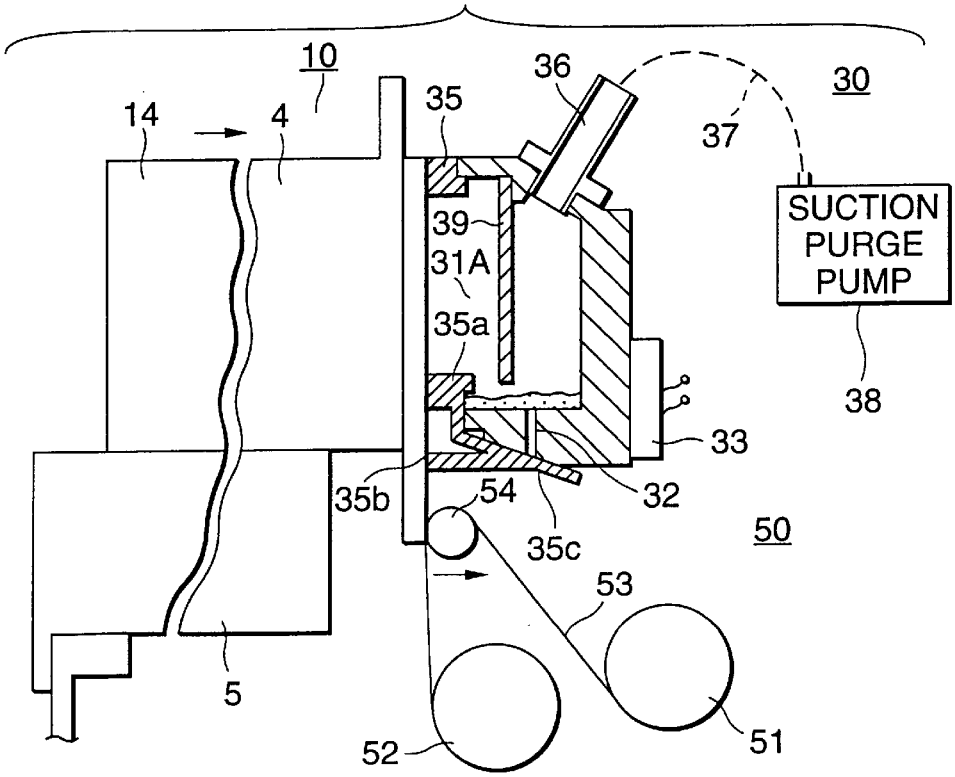
FIG. 2 is a sectional view showing the purging operation of the printer in the present invention.
Figure 3:
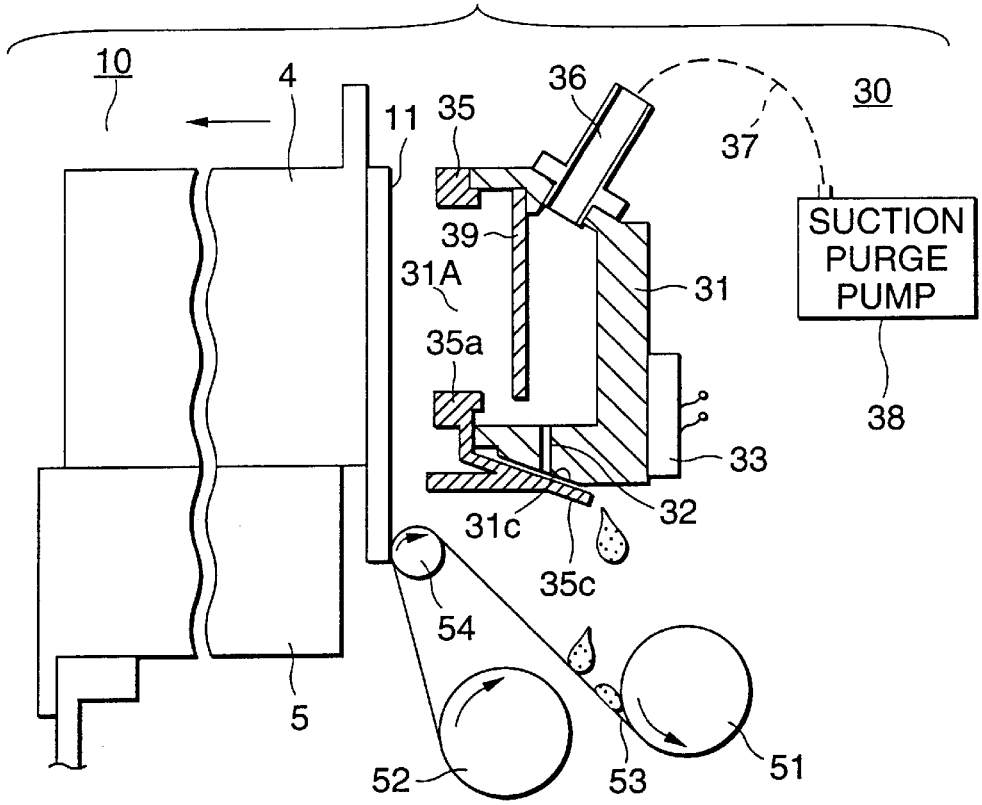
FIG. 3 is a sectional view showing the purging operation of the printer in the present invention.
Figure 4:
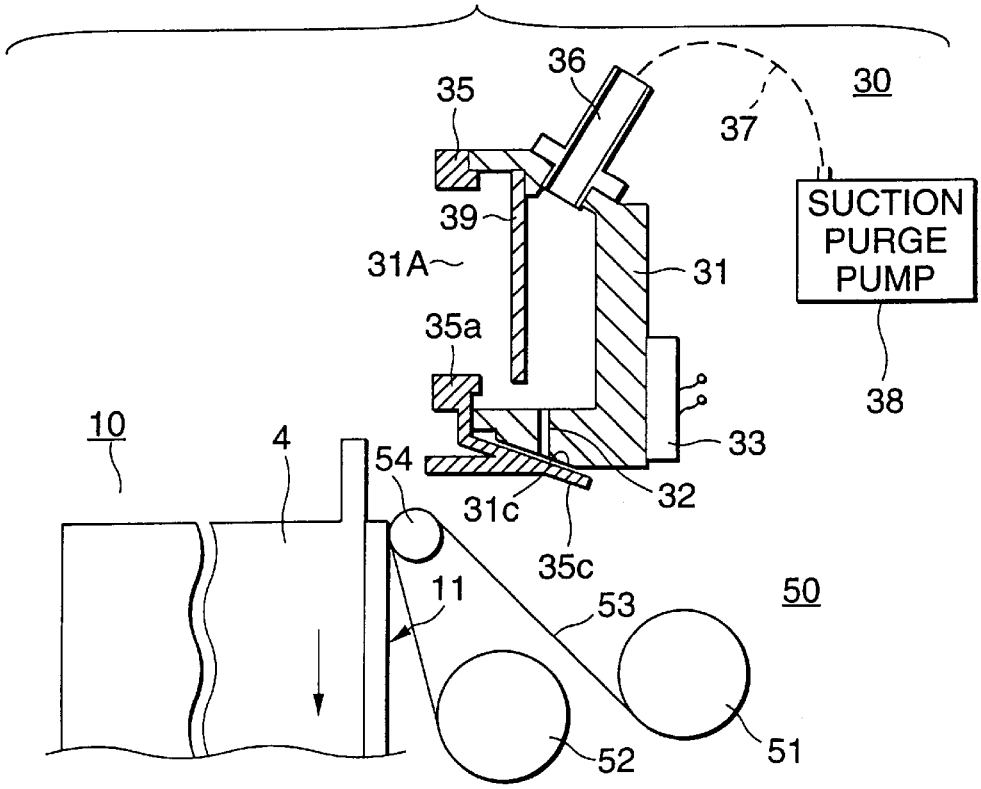
FIG. 4 is a sectional view showing the purging operation of the printer in the present invention.

FIGS. 1 to 4 are sectional views showing the positional relation between the ink jet head 10 and the ink purge unit 30. FIG. 1 shows a before-purge state; FIG. 2 shows a purge state; FIG. 3 shows a state of ink ejection after purging; and FIG. 4 shows a nozzle-wiping state.

As shown in those drawings, the ink jet head 10 with the nozzle portion (nozzle plate 11) and the ink tank 4 is so designed as to move forward and backward with respect to the ink purge unit 30. The forward and backward movement of the ink jet head 10 is executed on the carriage 5 in a state where the carriage 5 is left as it is as shown in FIG. 1.

The ink purge unit 30 includes an ink suction casing 31 an opening portion 31A of which is brought in close contact with and covers the nozzle portion when the ink jet head 10 moves forward up to a predetermined position facing the ink suction purge unit 30. For example, the opening portion 31A of the ink suction casing 31 has an elastic seal member 35 at its periphery, and the elastic seal member 35 comes in close contact with the nozzle plate surface 11 of the ink jet head 10.

The ink suction casing 31 has a suction inlet 36 at its upper surface and is connected to a suction pump (vacuum pump) 38 through the suction inlet 36 and a hose 37. A barrier portion 39 for shielding the suction inlet 36 from the opening portion 31A is disposed within the ink suction casing 31 so as to be suspended from the upper side of the casing 31, and the intervention of the barrier portion 39 prevents the suction ink from being sucked toward the suction inlet 36 side. On the bottom portion of the ink suction casing 31 are disposed an ink discarding hole 32 for exhausting the suction ink collected within the casing 31, and open/close means 35*c* for the ink discarding hole 32. The open/close means 35*c* also referred to as a resilient ink discharge hole closing structure, is made of an elastic member and basically structured as follows: That is, the open/close means 35*c* has a protrusion portion 35*b* that protrudes forwardly from the position of the opening surface 31A of the ink casing 31 when the tip end of the protrusion portion 35*b* is out of contact with the ink jet head 10. When the ink jet head 10 is forwarded toward the ink purge unit 30 side, the open/close means 35*c* closes the ink discarding hole 32 and closes the ink discarding hole 32 while being pushed through the protrusion portion 35*b* by the ink jet head 10 as shown in FIG. 2. When the ink jet head 10 and the protrusion portion 35*b* are out of contact with each other, the open/close means 35*c* is apart from the ink discarding hole 32 due to an elastic restore force. The specific example of the open/close means 35*c* will be described below.

The open/close means 35*c* is formed of a valve portion 35*c* which is made of an elastic member and molded integrally with the seal member 35. The valve portion 35*c* is shaped in an inclined plate and placed on an extension of the protrusion portion 35*b* and below the ink discarding hole 32. The valve portion 35*c* is supported in a cantilever manner at a lower edge 35*a* of the seal portion 35 through a beam portion 35*d*. The valve portion 35*c* is obliquely attached to the protrusion portion 35*b*. An inclined surface 31*c* facing the valve portion 35*c* is formed on the peripheral bottom portion of the ink discarding hole 32 of the ink suction casing 31.

That is, since the valve portion 35*c* and the ink suction casing 31 obliquely faces each other, when the protrusion portion 35 is pushed by the ink jet head 10, the valve portion 35*c* abuts against the inclined surface 31*c* of the ink suction casing 31, thereby closing the ink discarding hole 32.

Since the ink employed in this embodiment is a thermally meltable solid ink, a heater for heating the ink (not shown) is provided on the ink jet heat 10 side, and another heater 33 of the same type is also provided on the ink purge unit 30 side. The latter heater 33 is stuck to the back surface of the ink suction casing to heat the ink suction casing 31.

The elastic member of the seal member 35, the protrusion portion 35*b*, the valve portion 35*c*, etc., is molded with silicone rubber which is heat-resistant and soft. Reference numeral 35*a* designates a contact surface with respect to the nozzle plate; and the above-mentioned protrusion portion 35*b* is placed so as to slightly protrude from the contact surface 35*a*.

The ink sheet winding-up means 50 is disposed under the ink discarding hole 32 and includes a driving roller 51, a driven roller 52, and a pulley 54 disposed at a slight distance from the nozzle plate 11 so as to face the nozzle plate 11 before purging. The ink sheet 53 is set so as to be wound on the driven roller 52 and taken up on the driving roller 51 through the pulley 54. Further, the ink discarding hole 32 of the ink suction casing 31 is disposed above the ink sheet 53 between the pulley 54 and the driving roller 51.

The operation will be described below.

When ink jetting from the nozzles is abnormal at printing time or at non-printing time, the ink jet head 10 on the easel is moved to a position facing the suction purge means 30 (FIG. 1). In this case, the ink-absorbent sheet 53 has not come into contact with the nozzle surface 11 yet.

Then, the ink tank 4 and the nozzle plate 11 are advanced toward the suction purge means 30 by a moving means (not shown). At the same time when the nozzle plate 11 comes into contact with the contact surface 35*a* of the elastic body 35, the nozzle plate 11 presses the protrusion portion 35*b* of the elastic body. As a result, the valve portion 35*c* on the extension of the protrusion portion 35*b* can block the ink discarding hole 32 provided in the lower portion of the ink casing 31 (FIG. 2).

Further, in this configuration, before the nozzle plate 11 is advanced and brought into contact with the suction purge means 30, the lower portion of the nozzle plate 11 comes into contact with the ink-absorbent sheet 53. When the nozzle plate 11 is further advanced so as to come into contact with the suction purge means 30, the pulley 54 which is a part of the ink-absorbent sheet winding-up means 50 is pushed by the nozzle plate so as to move to the right in the drawing. By moving only the pulley for the ink sheet in the aforementioned manner, the movable portion can be suppressed to be in a small range compared with the case where the ink sheet winding-up means is rocked as a whole. Further, by setting the ink sheet winding-up direction to be substantially perpendicular to external force at pressing time, the contact pressure between the head and the ink sheet can be prevented from being reduced greatly when the ink sheet is wound up.

When the suction purge pump 38 is driven in the condition that the ink discarding hole 32 is blocked by the valve portion 35*c*, that is, in the condition of FIG. 2, ink is sucked out from the nozzle plate 11 and then reserved in the inside of the ink casing 31.

Then, the ink tank 4 and the nozzle plate 11 are retracted by the moving means. When the nozzle plate 11 is retracted to a position where the nozzle plate 11 is not in contact with the protrusion portion 35*b* of the elastic body, the state of the valve portion 35*c* blocking the ink discarding hole 32 is returned to its original state by restoring force. As a result, waste ink reserved in the inside of the ink casing 31 can be discharged to the ink sheet 53 through the ink discarding hole 32 (FIG. 3). If the driving roller 51 is operated in synchronism with the timing of discarding waste ink in this case, waste ink on the ink sheet can be rolled up with a substantially uniform thickness. Incidentally, also in this case, the ink-absorbent sheet 53 is placed so as to be in contact with the nozzle plate 11.

Further, by moving the ink jet head 10 downward as shown in FIG. 4, ink deposited on the nozzle plate 11 can be wiped. If the ink-absorbent sheet 53 is wound up in linkage with the movement of the ink jet head in this case, nozzle wiping can be performed more efficiently.

Figure 5:
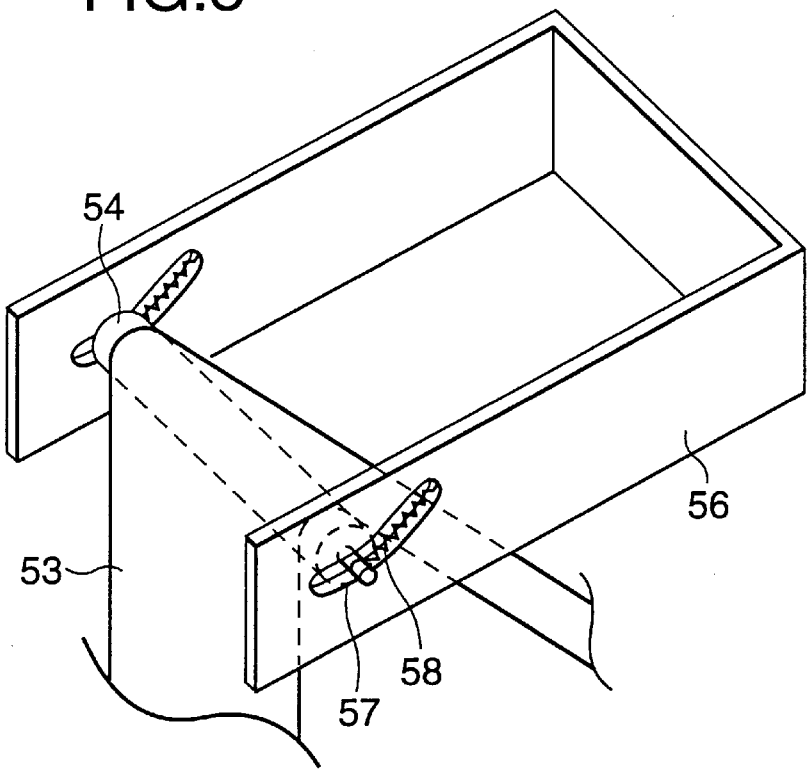
FIG. 5 is a perspective view showing a part of the configuration of the ink-absorbent sheet winding-up means in the present invention.

FIG. 5 shows the pulley portion 54 of the ink-absorbent sheet winding-up means for making the aforementioned operation possible.

In the drawing, slots 57 for supporting opposite ends of the pulley 54 are provided in the guide cover 56. Further, springs 58 each having one end engaged with the pulley 54 and the other, opposite end fitted to the guide cover are set in the slots 57 respectively. Accordingly, when the ink jet head 10 (not shown) located in the left of the pulley 54 in the drawing is pressed to the right in the drawing in connection with the purging operation, the pulley 54 can move right along the slots 57.

As described above, in this configuration, only the pulley 54 is moved together with the nozzle plate 11, so that a series of purging operation can be performed.

Figure 6:
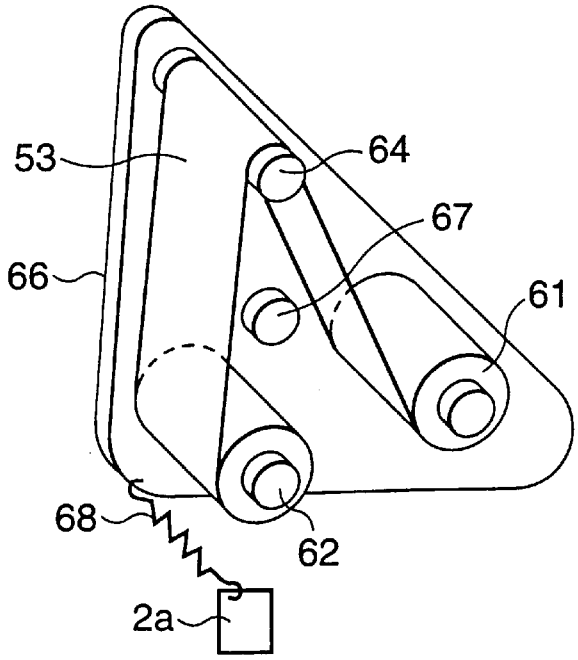
FIG. 6 is a perspective view of the ink-absorbent sheet winding-up means as another example of the present invention.

FIG. 6 shows another configuration than FIG. 5. In FIG. 6, the whole of the ink-absorbent sheet winding-up means 50 is operated so that the purging operation can be performed.

In the drawing, the reference numeral 61 designates a driving roller; 62, a driven roller; 64, a pulley; 66, a guide base for supporting the driving roller, the driven roller and the pulley; 67, a pivot for rocking the guide base; and 68, a spring for fitting the guide base to a part 2*a* of the easel.

The ink jet head 10 (not shown) is disposed in the left of the pulley 64 in the drawing. When the ink jet head 10 moves right, the nozzle plate 11 presses the pulley 64 through the ink-absorbent sheet 53. As a result, the whole of the ink-absorbent sheet winding-up means 50 rotates around the pivot 67 (operation of FIG. 2). If the nozzle plate is then moved left in the drawing, the state of the ink-absorbent sheet winding-up means 50 can be returned to its original state by restoring force of the spring 68.

As described above, according to the present invention, the nozzle surface could be wiped by a simple configuration. Further, ink could be prevented from being spilled around the head when a series of purging operation was carried out.

What is claimed is:

1. An ink purge apparatus for use in a printer in which an ink received within an ink tank of an ink jet head is sucked from a nozzle portion of the ink jet head and discharged, said apparatus comprising:

an ink suction casing including an opening portion that comes in close contact with and covers the nozzle portion of the ink jet head when the ink jet head moves in a first direction to a given position;

a mechanism constructed and arranged to move the nozzle portion of the ink jet head in the first direction and a second direction generally opposite to the first direction with respect to the ink suction casing;

a suction pump connected to the ink suction casing;

the ink suction casings having an ink discarding hole portion provided on the bottom thereof to discharge the ink sucked by the pump and collected within the ink suction casing;

a resilient ink discharge hole closing structure fixed to the ink suction casing constructed and arranged to close the ink discarding hole portion, the closing structure including a protrusion portion which is made of an elastic member, the protrusion portion having a tip which protrudes from the opening surface of the ink suction casing when the tip is not in contact with the ink jet head, the closing structure closing the ink discarding hole while being pushed by the ink jet head when the ink jet head moves forward toward the ink purge casing.

2. An ink purge apparatus for use in a printer as claimed in claim 1, wherein the opening portion of the ink suction casing has an elastic seal member which is brought into close contact with the nozzle portion of the ink jet head, the closing structure is molded integrally with the seal member and has a valve portion located on an extension of the protrusion portion and below the ink discarding hole, and the valve portion and a peripheral bottom portion of the ink discarding hole of the ink suction casing are inclined and face each other.

3. An ink purge apparatus for use in a printer as claimed in claim 1, wherein said printer includes an easel to which an object to be printed is fixed and guides disposed on said easel for guiding the movement of the ink jet head horizontally and vertically, and said ink purge unit is disposed on an arbitrary end portion of said easel.

4. An ink purge apparatus for use in a printer as claimed in claim 1, wherein ink received within the ink tank of the ink jet head is a thermally meltable ink, and the ink purge apparatus includes a heater to melt the ink within the ink suction casing.

5. An ink purge method for use in a printer in which a thermally melted ink received within an ink tank of an ink jet head is sucked and discharged from a nozzle portion of the ink jet head toward the exterior of the ink jet head by an ink purge apparatus, said method comprising:

providing an ink discard hole on a bottom portion of an ink suction casing of the purge apparatus from which the sucked melted ink is discharged;

disposing an ink absorbent sheet and an ink absorbent sheet winding mechanism below the ink discard hole; and discarding the ink sucked and collected by the purge apparatus onto the ink absorbent sheet while the ink absorbent sheet is wound up by the winding mechanism to discard the ink.

6. A nozzle wiping apparatus for use in a printer comprising an ink jet head constituted by an ink tank for reserving ink, a plurality of nozzles provided so as to discharge ink as liquid drops by an ink drop generating mechanism, a carriage for carrying these nozzles to an arbitrary position, an easel erected substantially vertically, a printing medium fixed onto the easel, an ink purge apparatus disposed at an arbitrary end portion on the easel and in a position facing the nozzles to perform a purging operation in which ink is sucked from the nozzles and discarded through an ink discard hole, and a moving mechanism for moving the nozzles in a first direction and a second direction which is opposite to the first direction relative to the purge apparatus, whereby printing is performed by moving horizontally and vertically relative to the easel, said nozzle wiping apparatus comprising:

an ink-absorbent sheet placed below the ink discard hole to collect the sucked ink discarded through the ink discard hole;

an ink absorbent sheet winding mechanism to wind up the ink-absorbent sheet; and means for keeping the ink-absorbent sheet in contact with a part of the nozzles after completion of the purging operation so the nozzles may be moved relative to the ink-absorbent sheet to thereby wipe ink deposited on the nozzles.

7. A nozzle wiping apparatus according to claim 6, wherein the ink-absorbent sheet winding mechanism comprises a driving roller, a driven roller, a pulley, a guide cover slidably engaged with opposite ends or one end of the pulley, and a spring having one end fixed to the guide cover and the other end fitted to one end of the pulley.

8. A nozzle wiping apparatus according to claim 7, wherein a part of the ink-absorbent sheet winding mechanism is made rockable in linkage with the purging operation.

9. A nozzle wiping apparatus according to claim 6, wherein the ink-absorbent sheet winding mechanism comprises a driving roller, a driven roller, a pulley, a guide base for rotatably mounting the pulley, the driving roller and the driven roller, a pivot for making the guide base rockable, and a spring laid between the easel and the guide base.

10. A wiping method for use in a printer comprising an ink jet head constituted by an ink tank for reserving ink, a plurality of nozzles provided so as to discharge ink as liquid drops by an ink drop generating mechanism, a carriage for carrying these nozzles to an arbitrary position, an easel erected substantially vertically, a printing medium fixed onto the easel, an ink pure apparatus disposed at an arbitrary end portion on the easel and in a position facing the nozzles to perform a purging operation in which ink is sucked from the nozzles and discarded through an ink discard hole, and a moving mechanism for moving the nozzles in a first direction and a second direction which is opposite to the first direction relative to the purge apparatus, whereby printing is performed by moving horizontally and vertically relative to the easel, said method comprising:

moving the ink jet head resting in the arbitrary position on the easel to a position facing the purge apparatus;

advancing the ink jet head toward the purge apparatus to bring only the ink-absorbent sheet into contact with a part of a nozzle plate;

continuing to advance the ink jet head to bring the ink jet head into contact with the purge apparatus to perform a purging operation;

retracting the ink jet head from the purge apparatus while keeping the ink-absorbent sheet in contact with the nozzle plate after completion of the purging operation; and moving the ink jet head downward while keeping the ink-absorbent sheet in contact with the nozzle plate to thereby wipe ink deposited on the nozzle plate.

* * * * *